US006528478B2

(12) United States Patent
Totoki

(10) Patent No.: US 6,528,478 B2
(45) Date of Patent: Mar. 4, 2003

(54) CLEANING CHEMICAL COMPOSITION COMPRISING AN AMINE OXIDE, ALKANOLAMINE, AND ORGANIC SOLVENT

(76) Inventor: Takatushi Totoki, P.O. Box 33427, St. Paul, MN (US) 55133-3427

( * ) Notice: Subject to any disclaimer, the term of this patent is extended or adjusted under 35 U.S.C. 154(b) by 0 days.

(21) Appl. No.: 10/023,237

(22) Filed: Dec. 18, 2001

(65) Prior Publication Data

US 2002/0082185 A1 Jun. 27, 2002

Related U.S. Application Data

(63) Continuation of application No. 09/673,694, filed on Oct. 16, 2000, now abandoned.

(51) Int. Cl.[7] ..... C11D 1/75; C11D 3/44

(52) U.S. Cl. ..... 510/503; 510/235; 510/237; 510/245; 510/251; 510/264; 510/332; 510/338; 510/342; 510/365; 510/371; 510/405; 510/407; 510/432; 510/499

(58) Field of Search ..... 510/235, 237, 510/245, 251, 264, 332, 338, 342, 365, 371, 405, 407, 432, 499, 503

(56) References Cited

U.S. PATENT DOCUMENTS

| | | | | |
|---|---|---|---|---|
| 4,243,559 A | | 1/1981 | Imamura et al. | |
| 5,180,749 A | * | 1/1993 | Cusack et al. | 514/726 |
| 5,534,184 A | * | 7/1996 | Underwood | 510/426 |

FOREIGN PATENT DOCUMENTS

| | | |
|---|---|---|
| JP | 48-49809 | 7/1973 |
| JP | 61-14297 | 1/1986 |
| JP | 61-151300 | 7/1986 |
| JP | 6-228591 | 8/1994 |
| JP | 7-216399 | 8/1995 |
| JP | 7-224299 | 8/1995 |
| JP | 9-151395 | 6/1997 |

* cited by examiner

*Primary Examiner*—Charles Boyer
(74) *Attorney, Agent, or Firm*—Alan Ball; G. F. Chernivec

(57) ABSTRACT

To provide a cleaner composition suitable for removing oxidized grease stains adhering to the surface of floor, wall and cooking instruments in the kitchen.

A cleaner composition is constructed to have the concentrated form and comprise a water-insoluble organic solvent, amines and a nonionic amine oxide-based surfactant.

5 Claims, No Drawings

CLEANING CHEMICAL COMPOSITION COMPRISING AN AMINE OXIDE, ALKANOLAMINE, AND ORGANIC SOLVENT

This is a continuation of Application No. 09/673,694 filed Oct. 16, 2000 abn.

TECHNICAL FIELD

The present invention relates to a cleaner composition, more specifically, the present invention relates to a concentrated cleaner composition particularly for business use, which is suitable for removing oxidized grease stains adhering to the surface of floor, wall and cooking instruments in the kitchen, particularly denatured grease stains.

BACKGROUND ART

Conventionally, cleaners for washing and removing the stain of oils and fats (hereinafter referred to as "grease stains") have been used after selecting a cleaner depending on the kind of the grease stain. For example, when the grease stain is newly formed and not denatured, the cleaner used comprises a surfactant and a solvent. A cleaner mainly used for removing grease stains adhering to the surface of floor, wall and cooking instruments in the kitchen (hereinafter collectively called "kitchen inside and the like") and denatured by the action of heat or oxygen in air usually comprises a surfactant, a solvent and an alkali agent. The surfactant/solvent/alkali agent-base cleaner uses an inorganic alkali salt such as sodium hydroxide, potassium hydroxide or sodium silicate, or an amine as the alkali agent in combination with the surfactant and the solvent. The solvent predominantly used is a terpene-base or alkylene glycol-base solvent. These known cleaners are described in detail, for example, in Japanese Examined Patent Publication (Kokoku) No. 50-40126, Japanese Unexamined Patent Publication (Kokai) No. 54-158408, Japanese Examined Patent Publication (Kokoku) No. 56-45519, and Japanese Unexamined Patent Publication (Kokai) Nos. 61-14297, 61-151300, 4-61917, 4-73478, 6-228591, 7-216399 and 7-224299.

The grease stain in the kitchen inside and the like is generally left standing as it is and deeply denatured to result in a persistent stain and the above-described general-purpose cleaners cannot thoroughly wash and remove the persistent grease stain because of its weak detergency. Accordingly, in the case when the grease stain in the kitchen inside and the like is removed using a conventional cleaner, it has been necessary to repeat the cleaning operation or strongly rub and strip off the adhering stain.

The cleaning composition of the present invention has a purpose of removing the grease stain adhering to home kitchen and kitchen goods and is not limited to the use in business to remove the grease stain in the kitchen inside and the like. In this respect, a cleaning composition comprising (1) N-methyl-2-pyrrolidone, (2) an alkali agent, (3) a surfactant and (4) water is known as an attempt to increase the detergency for the denatured grease stain (see, Japanese Unexamined Patent Publication (Kokai) No. 9-151395), though this is different from the present invention. The N-methylol-2-pyrrolidone has hitherto been used as a scale removing agent or degreasing cleaner of a chemical plant and is used in the above-described cleaner composition in place of a conventional solvent.

Most of cleaners for business use are usually provided in the form of a concentrated product so as to get rid of problems such as storage space. The concentrated cleaner generally has a composition mainly comprising sodium hydroxide or sodium silicate as an alkali agent and using a water-soluble solvent and a surfactant in combination. The concentrated cleaner can be usually used after diluting it to from 10 to 100 times. In the case when this type of cleaner for business use is used to remove the denatured grease, the stock solution is predominantly diluted to at most about 20 times on use. However, detergency satisfactorily strong for the persistent denatured grease stain has not yet been attained.

Accordingly, the object of the present invention is to provide a concentrated cleaner composition suitable particularly for the business use, which can overcome the above-described problems of conventional cleaners and exert strong detergency for the oxidized grease stain or persistent denatured grease stain adhering to the surface of floor, wall and cooking instruments in the kitchen even when it is diluted on use at a high dilution magnification of at least 20 times or more.

The above-described object of the present invention can be attained by a concentrated cleaner composition comprising the following components:

a) a water-insoluble organic solvent b) amines, and c) a nonionic amine oxide-based surfactant.

In one preferred embodiment, the concentrated cleaner composition of the present invention comprises the water-insoluble organic solvent in an amount of from 5 to 50 wt %, the amines in an amount of from 5 to 50 wt % and the nonionic amine oxide-based surfactant as an aqueous solution thereof in an amount of from 20 to 90 wt %.

The preferred embodiment of the present invention is described below. In the concentrated cleaner composition of the present invention, the first component a) is a water-insoluble organic solvent. The water-insoluble organic solvent works for dissolving the grease stain and increasing the detergency. This organic solvent is "water-insoluble" and therefore, it is particularly effective in improving the affinity for grease. The term "water-insoluble" as used in the present invention means a property such that when a certain material (solute) is mixed with pure water at room temperature under the atmospheric condition and tried to dissolve therein, the degree of the dissolution of the solute, namely, the solubility is 20% or less.

The water-insoluble organic solvent is not particularly limited as long as it can satisfy the requirement in the definition of "water-insoluble" and substantially dissolve a saturated or unsaturated fatty acid, however, preferred examples thereof include diphenyl ether, 2-ethyl-1-hexanol, 2-ethylhexane-1,3-diol, phenyl methyl carbitol, phenyl glycol ethers, benzyl alcohol, 2-octanol, n-octanol, decanol, indecanol and dodecanol. Among these, benzyl alcohol, phenyl glycol ethers and phenyl methyl carbitol can be advantageously used because of their high detergency, good affinity for an amine used in combination and as a result, good compatibility, and excellent solubility. If the water-insoluble organic solvent is not used and the concentrated cleaner composition of the present invention is constructed by an amine and an amine oxide-base surfactant, the cleaner composition is extremely reduced in the detergency.

In general, the water-insoluble organic solvent is preferably used in an amount of from 5 to 50 wt % (based on the total weight of the cleaner composition), more preferably from 20 to 45 wt %. If the amount of the water-insoluble organic solvent used is less than 5 wt %, the cleaner composition is reduced in the detergency and not suitable for use in removing the oxidized grease stain or persistent denatured grease stain, whereas if it exceeds 50 wt %, the cleaner composition can be difficultly formed into a uniform solution.

The second component b) is amines. Amines dissolve the grease stain and the detergency is improved by the addition of a small amount of an amine. In other words, amines act as a "degreasing agent". Amines which can be used include aliphatic or aromatic primary amines which have been hitherto generally used as a degreasing agent. Examples of amines which can be advantageously used include monoethanolamine, diethanolamine, triethanolamine, propanolamine, ethylamine, benzylamine, butylisopropanolamine,N-(β-aminoethyl)ethanolamine, N-methylmonoethanolamine, N-ethylmonoethanolamine, N-butylmonoethanolamine,
N-methyldiethanolamine and N-butyldiethanolamine. Among these, monoethanol amine is preferred because it can be used as a solvent capable of dissolving saturated or unsaturated fatty acids. However, amines used in an amount of 20 wt % or more are classified as a "poisonous substance outside drugs" provided in the Poisonous Substance Regulation Law and an amine other than those described above is preferably added for the supplementation.

Amines are preferably used in an amount of from 10 to 45 wt % (based on the total weight of the cleaner composition). If the amount of amines used is less than 10 wt %, the cleaner composition is reduced in the detergency and not suitable for removing the oxidized grease stain or persistent denatured grease stain, whereas if it exceeds 45 wt %, the detergency is improved but the safety is impaired. If amines are not used and the concentrated cleaner composition of the present invention is constructed by a water-insoluble organic solvent and an amine oxide-based surfactant, the water-insoluble organic solvent cannot be solubilized.

The third component c) is a nonionic amine oxide-based surfactant. The amine oxide-based surfactant improves an washing power and at the same time can act as a solubilizing agent of the water-insoluble organic solvent. Examples of amine oxide-based surfactants preferred in practicing the present invention include laurylamine oxide, decylamine oxide, myristylamine oxide, cetylamine oxide and isoalkylamine oxide (CAS: 151151-28-9), however, the present invention is by no means limited thereto. In the case when the cleaner composition is intended to provide a diluted solution suppressed in foaming, namely, a diluted solution having low foamability such that good foam breakage and swift rinsing are obtained, isoalkylamine oxide is preferably used. On the contrary, when the cleaner composition provides a diluted solution having high foamability suitable for cleaning grease stains on the wall surface, laurylamine oxide is preferably used.

The amine oxide-based surfactant in usual is preferably used in an amount of from 20 to 90 wt % (based on the total weight of the cleaner composition). This surfactant may be used as a stock solution but preferably used in the form of an aqueous solution. The aqueous solution of the surfactant may be used in various concentrations, however, it is preferably used in the form of a 30% aqueous solution which is easily available on the market. In the case of using a 30% aqueous solution, the amine oxide-based surfactant is suitably used in an amount of from 20 to 80 wt %. If the amount of the surfactant used is less than 20 wt %, the cleaner composition is reduced in the detergency and not suitable for removing the oxidized grease stain or persistent denatured grease stain, whereas even if the surfactant is used in excess of 80 wt %, the effect cannot surpass the effect achieved with the addition of the surfactant in an amount of 80 wt %.

In the concentrated cleaner composition of the present invention, the main components a), b) and c) may be used individually or if desired, two or more compounds may be used in combination.

In addition to these components, the concentrated cleaner composition of the present invention may contain additives commonly used in the field of the cleaner composition. Examples of suitable additives include another surfactant, an inorganic alkali salt, a thickener, an abrasive, an antimicrobial, a coloring material (e.g., dye) and a perfume. One or more of these additives may be added in the range of not impairing the effect of the present invention. Among these additives, an inorganic alkali salt is effective for improving the detergency. Examples of suitable inorganic alkali salts include sodium hydroxide, potassium hydroxide and sodium silicate. The alkali salt is usually added in an amount of from 0.1 to 5 wt %.

The concentrated cleaner composition of the present invention can be prepared by blending the above-described components in a usual manner. All components may be mixed at once or the components may be blended in several installments, though it may be widely varied depending on the factors such as the kind and use amount of the components.

By using the concentrated cleaner composition of the present invention, the oxidized grease stain or persistent denatured grease stain adhering to the surface of floor, wall and cooking instruments in the kitchen can be effectively washed and removed. When the cleaner composition is used for this purpose, the stock solution may be diluted to from 1 to 50 times, and for washing not so persistent normal grease stain, the stock solution may be diluted to from 50 to 100 times.

The present invention is described below by referring to the Examples. In the Examples, unless otherwise indicated, the amount of each component used is in the unit of "wt %".

EXAMPLES 1 to 6

In each Example, a concentrated cleaner composition (Example of the present invention) having the composition shown in Table 1 below was prepared. The components were blended by batchwise mixing all amounts and stirring the mixture.

The concentrated cleaner compositions obtained were subjected to the following detergency test and evaluated on the detergency for the denatured grease stain. The results are shown in Table 1 below.

A commercially available edible oil (for fries) was charged into an empty pudding container (50 ml) and heated in an oven at 250° C. over 5 hours to cause thermal denaturation. The edible oil after the thermal denaturation was coated on a stainless steel plate having a size of 25 mm×75 mm to have a coverage of 100 mg±10 mg and this coating was used as a test piece (model stain). Each concentrated cleaner composition was diluted to have a ratio in dilution (%) shown in Table I and in the cleaner solution obtained, the test piece was dipped over 30 minutes. The difference in the weight between before and after the dipping of each test piece was determined and the removal percentage of the denatured oil was produced and used as the washing ratio (%).

COMPARATIVE EXAMPLES 7 to 12

The procedure of Examples 1 to 6 was repeated except for preparing comparative concentrated cleaner compositions each having the composition shown in Table 1 below. More specifically, the concentrated cleaner compositions were prepared not using an amine in Comparative Example 7, not using an amine oxide-base surfactant in Comparative Example 8, and not using a water-insoluble organic solvent in Comparative Examples 9 and 10. In Comparative Examples 11 and 12, a sodium silicate-base concentrated cleaner for business use, which is commercially available from Company A, was used. The concentrated cleaner compositions each was evaluated on the detergency for the denatured grease stain in the same manner as in Examples 1 to 6. The results obtained are shown in Table 1 below.

TABLE 1

| | Example | | | | | | Comparative Example | | | | Comparative Example | |
|---|---|---|---|---|---|---|---|---|---|---|---|---|
| | 1 | 2 | 3 | 4 | 5 | 6 | 7 | 8 | 9 | 10 | 11 (A) | 12 (A) |
| Monoethanolamine | 19 | 19 | 19 | 19 | 19 | 19 | | 19 | 19 | 19 | | |
| N-Methyl Ethanolamine | 10 | 10 | 10 | 10 | 10 | 10 | | 10 | 10 | 10 | | |
| Isoalkylamine oxide (30% aqueous solution) | 31 | 31 | 31 | 30 | 30 | 30 | 31 | | 31 | 31 | | |
| Benzyl alcohol | 40 | 40 | 40 | 40 | 40 | 40 | 40 | 40 | | | | |
| Water | | | | | | | 29 | 31 | 40 | 40 | | |
| Sodium silicate | | | | 1 | 1 | 1 | | | | | | |
| Ratio in dilution (%) | 3 | 2 | 1 | 3 | 2 | 1 | Separation | Separation | 3 | 2 | 10 | 5 |
| Detergency test result/washing ration (%) | 13 | 5 | 1 | 18 | 7 | 2 | — | — | 2 | 1 | 15 | 8 |

(A) sodium silicate-based concentrated cleaner for business use

In Table 1, "separation" means that the benzyl alcohol could not be completely dissolved. As seen from the results of the detergency test in Table 1, the cleaner compositions having a composition out of the scope of the present invention must be increased in the ratio in dilution so as to obtain highly satisfactory detergency.

According to the present invention, a concentrated cleaner composition particularly for the business use, which is suitable for removing oxidized grease stains adhering to the surface of floor, wall and cooking instruments in the kitchen, particularly denatured grease stains, can be obtained.

What is claimed is:

1. A concentrated cleaning composition comprising:

(a) a water-insoluble organic solvent having a concentration from about 5 wt % to about 50 wt %, wherein said water insoluble organic solvent is selected from the group consisting of alkanols, substituted alkanols, benzyl alcohol, phenyl glycol ethers and phenyl methyl carbitol;

(b) at least one amine in an amount from about 5 wt % to about 50 wt %, wherein said at least one amine is selected from the group consisting of alkanolamines, ethylamine and benzylamine; and (c) at least one nonionic amine oxide-based surfactant in an amount from about 20 wt % to about 90 wt %.

2. The composition of claim 1 wherein said water-insoluble organic solvent has a solubility in water of less than about 20 per cent.

3. The composition of claim 1 wherein said nonionic amine oxide-based surfactant is selected from the group consisting of laurylamine oxide, decylamine oxide, myristylamine oxide, cetylamine oxide and isoalkylamine oxide.

4. The composition of claim 1, wherein said concentration of said water insoluble organic solvent is from about 20 wt % to about 45 wt %.

5. The composition of claim 1, wherein said alkanolamines being selected from the group consisting of monoethanolamine, diethanolamine, triethanolamine, propanolamine, butylisopropanolamine, N-(β-aminoethyl) ethanolamine, N-methyl-monoethanolamine, N-ethylmonoethanolamine, N-butylmonoethanolamine, N-methyl-diethanolamine and N-butyldiethanolamine.

* * * * *